United States Patent [19]

Kamio et al.

[11] 4,125,636

[45] Nov. 14, 1978

[54] DESENSITIZING COMPOSITION AND DESENSITIZING METHOD

[75] Inventors: Takayoshi Kamio; Akio Miyamoto, both of Minami Ashigara, Japan

[73] Assignee: Fuji Photo Film Co., Ltd., Minami Ashigara, Japan

[21] Appl. No.: 703,147

[22] Filed: Jul. 7, 1976

[30] Foreign Application Priority Data

Jul. 7, 1975 [JP] Japan ..... 50/83305

[51] Int. Cl.[2] ..... B41M 5/00

[52] U.S. Cl. ..... 427/150; 96/62; 106/2; 427/145; 427/151; 427/152; 427/259; 427/261

[58] Field of Search ..... 427/150, 151, 145, 152, 427/1, 259, 261; 106/2; 96/62; 282/27.5; 428/914; 260/482 R

[56] References Cited

U.S. PATENT DOCUMENTS

| | | | |
|---|---|---|---|
| 2,132,169 | 10/1938 | Kumetat et al. | 96/62 |
| 2,440,954 | 5/1948 | Jennings | 96/62 |
| 2,777,780 | 1/1957 | Cormach et al. | 427/261 |
| 3,083,149 | 3/1963 | Cranston | 106/2 |
| 3,931,430 | 1/1976 | Toda et al. | 427/150 |
| 3,952,117 | 4/1976 | Miyamoto | 427/151 |
| 4,012,538 | 5/1977 | Miyamot et al. | 427/150 |
| 4,022,624 | 5/1977 | Miyamoto et al. | 106/2 |

FOREIGN PATENT DOCUMENTS

| | | | |
|---|---|---|---|
| 1,076,965 | 6/1967 | United Kingdom | 427/150 |

*Primary Examiner*—Ronald H. Smith
*Assistant Examiner*—Janyce A. Bell
*Attorney, Agent, or Firm*—Sughrue, Rothwell, Mion, Zinn and Macpeak

[57] ABSTRACT

A desensitizing composition used for a recording material capable of forming a color image by the reaction of a colorless color former and an adsorbent, which contains at least one compound obtained by the addition reaction of an $\alpha,\beta$-unsaturated carboxylic acid derivative or an $\alpha,\beta$-unsaturated ketone with an amine, is disclosed. A method of desensitizing an adsorbent contained in a recording material which comprises using such composition is also disclosed.

15 Claims, No Drawings

DESENSITIZING COMPOSITION AND DESENSITIZING METHOD

BACKGROUND OF THE INVENTION

1. Field of the Invention

This invention relates to a desensitizing composition and a desensitizing method. More particularly, it relates to a desensitizing composition which decreases or eliminates the function of an adsorbent capable of causing the color-formation of a colorless color former and to a method of desensitizing an adsorbent comprising using such composition.

2. Description of the Prior Art

It has long been known to form a color image through the reaction of a color former (a nearly colorless organic compound) and an adsorbent. This color-forming reaction has been, for example, applied to recording materials as described in U.S. Pat. Nos. 2,505,470, 2,505,489, 2,548,366 and 2,550,471; recording materials as described in U.S. Pat. Nos. 2,712,507, 2,730,456, 2,730,457 and 3,293,060; recording materials as described in U.S. application Ser. No. 40,732 and British Pat. No. 825,354; and other recording materials for spirit printing, stencil printing, automatic ticket vending systems, finger printing systems, letter writing systems, and the like.

In these recording materials, the color former and the adsorbent cause a color reaction when they come into contact, and, therefore, it is desired to prevent, by some means, color reaction in areas in which the formation of a color image is not required, from the viewpoint of performance and cost. For this purpose, desensitizers have so far been used, and there are known, for example, high molecular weight primary alkylamines such as dodecylamine, quaternary ammonium salts such as dodecyltrimethylammonium chloride and alkyl or arylamine acetates, as described in Japanese Patent Publication No. 3,921/58; monoalkylamines, aralkylamines and tertiary amines comprising ethanolamine chemically bonded with an ethylene oxide group, as described in Japanese Patent Publication No. 29,546/71; precondensates of urea resins as described in Japanese Patent Publication No. 35,697/71; secondary alkylamines such as didodecylamine, tertiary alkylamines such as triethylamine, primary arylamines such as aniline, aralkylamines such as benzylamine, polyhydroxy compounds such as polyethylene glycol or glycerol, etc.

However, these desensitizers are disadvantageous in that their desensitizing effect is insufficient, or even if they show a satisfactory effect, practically useful effects cannot be obtained unless they are used in large amounts. Therefore, the use of some desensitizers results in color formation in the desensitized areas even when used in large amounts; in particular, this defect tends to become more serious as color formers and adsorbents are improved.

For example, color formers having a fluoran nucleus are particularly difficult to desensitize as compared with Crystal Violet lactone, and the like. Moreover, the above desensitizers scarcely show a desensitizing effect on adsorbents such as phenol resins and metal salts of aromatic carboxylic acids. Therefore, the effective use of the advantageous properties of these adsorbents (for example, color images obtained using them do not disappear under the action of water) is restricted. Another defect of the conventional desensitizers is that when a solution of a color former which is microencapsulated is brought into contact with a desensitized adsorbent, the undesensitized areas of the adsorbent cause color formation with the passage of time (fogging).

In addition, conventional desensitizers often yellow on the adsorbents, or they have slow drying rate since they are used in a large amount, and therefore, it is difficult to increase the coating (printing) rate.

SUMMARY OF THE INVENTION

It is one object of this invention to provide a desensitizing composition having a strong desensitizing effect.

It is another object of this invention to provide a desensitizing composition which is excellent in coating properties and can be used both in the aqueous state and in the oily state.

A further object of this invention is to provide a desensitizing composition which has no adverse influence on a color former, an adsorbent or a system containing the same. The "adverse influence" of the desensitizing composition means, for example, bleeding, discoloring and fading of ink, cinnabar seal ink, or the like.

Still a further object of this invention is to provide a method of desensitizing an adsorbent which comprises using the above desensitizing composition.

The inventors have studied various approaches, and, as a result, have found that the above objects of this invention can be accomplished by using a desensitizing composition containing at least one compound obtained by the addition reaction of an $\alpha,\beta$-unsaturated carboxylic acid derivative or an $\alpha,\beta$-unsaturated ketone with an amine, or mixture thereof.

DETAILED DESCRIPTION OF THE INVENTION

The amines used for preparing the desensitizing component of this invention include ammonia, and aliphatic primary or secondary amines each having 1 to 20 carbon atoms, alicyclic hydrocarbon amines, cyclic amines and aromatic amines. These useful amines can be represented by the following general formulae:

$R_1NH_2$
$R_1NHR_2$
$H_2NR_3NH_2$

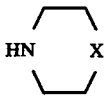

In these formulas, $R_1$ and $R_2$ each represent an alkyl group having 1 to 20 carbon atoms, an alkenyl group having 1 to 20 carbon atoms, a substituted alkyl group [having substituents such as a hydroxyl group, a phenyl group, a substituted (such as methyl, methoxy) phenyl group, a morpholino group or a piperazinyl group, where the alkyl moiety preferably has 1 to 20 carbon atoms], an alicyclic hydrocarbon group (such as cyclohexyl), a phenyl group, a substituted aryl group, for example, an aryl group such as a phenyl group substituted with a methyl group or methoxy group, an aromatic heterocyclic group such as pyridinyl, or the like, and $R_1$ and $R_2$ may be identical or different. $R_3$ represents an alkylene group, preferably having 1 to 8 carbon atoms, a cyclohexylene group, a polyazaalkylene group (such as an iminodiethylene group, a diiminotriethylene group, a hexaiminoheptaethylene group, an iminodi(-triethylene) group or a pentaiminohexa(hexamethylene)

group), a phenylene group, a pyridylene group, or the like. X represents an imino group, oxy or methylene.

Specific examples of preferred amines are given below, which are not limitative: methylamine, ethylamine, butylamine, laurylamine, palmitylamine, styrylamine, dimethylamine, diethylamine, dibutylamine, dicyclohexylamine, ethylenediamine, trimethylenediamine, hexamethylenediamine, decamethylenediamine, diethylenetriamine, triethylenetetramine, tetraethylenepentamine, di(trimethylene)triamine, di(hexamethylene)triamine, tetra(hexamethylene)pentamine, hexa(hexamethylene)heptamine, ethanolamine, cyclohexylamine, 1,4-diaminocyclohexane, morpholine, piperidine, N-aminoethylpiperazine, N-aminopropylpiperazine, piperazine, N-aminopropylmorpholine, benzylamine, aniline, anisidine, toluidine, phenylenediamine, aminopyridine, diaminopyridine, etc. One or more of the amines can be used, if desired or necessary.

Useful $\alpha,\beta$-unsaturated carboxylic acid derivatives and $\alpha,\beta$-unsaturated ketones used for preparing the compounds which are used as desensitizers in this invention include acrylic acid ester derivatives and amido derivatives, methacrylic acid ester derivatives and amido derivatives 2-butenoic acid ester derivatives and amido derivatives (crotonic acid and isocrotonic acid ester derivatives and amido derivatives), butene dicarboxylic acid ester derivatives and amido derivatives (maleic acid and fumaric acid ester derivatives and amido derivatives), 2-methylenebutane dicarboxylic acid ester derivatives and amido derivatives (itaconic acid ester derivatives and amido derivatives), vinylketones (such as methyl vinyl ketone and methoxyethyl vinyl ketone), and the like.

Preferred $\alpha,\beta$-unsaturated carboxylic acid derivatives and $\alpha,\beta$-unsaturated ketones can be represented by the following general formulae.

General Formulae:

a) $CH_2{=}CHCOOR_4$ b) $CH_2{=}CHCON(R_6)(R_7)$ c) $CH_3CH{=}CHCOOR_4$ d) $CH_3CH{=}CHCON(R_6)(R_7)$ e) $CH_2{=}C(CH_3)(COOR_4)$ f) $CH_2{=}C(CH_3)(CON(R_6)(R_7))$ g) $CH_2{=}C(CH_2COOR_5)(COOR_4)$ h) $CHCOOR_4 \parallel CHCOOR_5$ i) $CH_2{=}C(R_8)-COO\text{-}(CH_2)_mO\text{-}_nCO-C(R_8){=}CH_2$ j) $C(CH_2O-CO-C(R_8){=}CH_2)_4$ k) $CH_2{=}CHCOR_4$ In the above formulae, $R_4$ and $R_5$ each represent an alkyl group having 1 to 12 carbon atoms, a substituted alkyl group (having substituents such as a phenoxy group, a hydroxy group, a cyano group, an amino group, a hexyloxy group, a sulfo group or an alkoxy group having 1 to 10 carbon atoms, where the alkyl moiety preferably has 1 to 20 carbon atoms), a benzyl group, a cyclohexyl group, a saturated or unsaturated 6-membered heterocyclic group having one nitrogen atom or one oxygen atom, a phenyl group, a naphthyl group, a polyoxyalkylene group, preferably of the formula $\text{-}(CH_2)_{m_1}O\text{-}_{n_1}$, wherein $m_1$ is an integer of 2 to 4, and $n_1$ is an integer of 1 to 14 or the like, and $R_4$ and $R_5$ may be identical or different. $R_6$ and $R_7$ each represent a hydrogen atom, an alkyl group having 1 to 12 carbon atoms, a cyclohexyl group, a substituted alkyl group (having substituents such as a hydroxyl group, an alkoxy group having 1 to 6 carbon atoms, a dimethylamino group, a diethylamino group, an acyl group having 1 to 6 carbon atoms, a cyano group, a piperazinyl group or morpholinyl group, where the alkyl moiety preferably has 1 to 10 carbon atoms), a phenyl group, a naphthyl group, an acetyl group, a saturated or unsaturated 6-membered heterocyclic group having one nitrogen atom or one oxygen atom, and the like, and $R_6$ and $R_7$ may be identical or different, or may form a ring having 4 or 5 carbon atoms. $R_8$ represents a hydrogen atom or a methyl group. $m$ is an integer of 2 to 4, and $n$ is an integer of 1 to 14.

Preferred $\alpha,\beta$-unsaturated carboxylic acid derivatives include ester or amide derivatives of acrylic acid, methacrylic acid, crotonic acid, isocrotonic acid, maleic acid, fumaric acid and itaconic acid; preferred $\alpha,\beta$-unsaturated ketones include methylvinyl ketone and methoxymethylvinyl ketone; preferred amines include ammonia, primary or secondary aliphatic amines, alicyclic amines, cyclic amines and aromatic amines, which amines have at least one active hydrogen.

Specific examples of particularly preferred $\alpha,\beta$-unsaturated carboxylic acid derivatives and $\alpha,\beta$-unsaturated ketones are given below, which are not limitative: methyl acrylate, ethyl acrylate, n-propyl acrylate, isobutyl acrylate, 2-ethylhexyl acrylate, 2-phenoxyethyl acrylate, cyanoethyl acrylate, dimethylaminoethyl acrylate, benzyl acrylate, methoxybenzyl acrylate, cyclohexyl acrylate, furfuryl acrylate, tetrahydrofurfuryl acrylate, phenyl acrylate, 2-hydroxyethyl acrylate, 3-hydroxypropyl acrylate, 2-hydroxypropyl acrylate, 2,3-dihydroxypropyl acrylate, 4-hydroxybutyl acrylate, 5-hydroxypentyl acrylate, 2,2-dimethyl-3-hydroxypropyl acrylate, diethylene glycol monoacrylate, triethylene glycol monoacrylate, dipropylene glycol monoacrylate, glycerol monoacrylate, trimethylolethane monoacrylate, trimethylolpropane monoacrylate, pentaerythritol monoacrylate, 2-methoxyethyl acrylate, 2-ethoxyethyl acrylate, 2-(2-methoxyethoxy)ethyl acrylate, 2-(2-butoxyethoxy)-ethyl acrylate, $\omega$-methoxypolyethylene glycol acrylate [added moles of $\text{-}(CH_2CH_2O)\text{-}$, that is, in $CH_2{=}COO\text{-}(CH_2CH_2O)\text{-}_n-CH_3$, $n$ is 9; hereafter similar compounds are identified with "addition degree, number of mols, $n$ ="], $\omega$-methoxypolyethylene glycol acrylate (addition degree, number of mols, $n = 23$), acetoxyethyl acrylate, polyethylene glycol diacrylate (addition degree, number of mols, $n = 1$ to 14), polypropylene glycol diacrylate (addition degree, number of mols, $n = 9$), trimethylolpropane triacrylic trimethylolethane triacrylate, pentaerythritol tetraacrylate, methyl methacrylate, ethyl methacrylate, n-butyl methacrylate, sec-butyl methacrylate, cyclohexyl methacrylate, benzyl methacrylate, cyanoacetoxyethyl methacrylate, octyl methacrylate, sulfopropyl methacrylate, N-ethyl-N-phenylaminoethyl methacrylate, dimethylaminophenoxyethyl methacrylate, furfuryl methacrylate, tetrahydrofurfuryl methacrylate, cresyl methacrylate, naphthyl methacrylate, 2-hydroxypropyl methacrylate, 2,3-dihydroxypropyl methacrylate, 5-hydroxypentyl methacrylate, 2,2-dimethyl-3-hydroxypropyl methacrylate, diethylene glycol monomethacrylate, glycerol monomethacrylate, trimethylolethane monomethacrylate, pentaerythritol monomethacrylate, 2-methoxyethyl methacrylate, 2-(2-methoxyethoxy)ethyl methacrylate, ω-methoxypolyethylene glycol methacrylate (addition degree, number of mols, $n = 6$), ω-methoxypolyethylene glycol methacrylate (addition degree, number of mols, $n = 23$), acrylamide, methylacrylamide, ethylacrylamide, butylacrylamide, tert-butylacrylamide, heptylacrylamide, cyclohexylacrylamide, benzylacrylamide, hydroxymethylacrylamide, methoxyethylacrylamide, dimethylaminopropylacrylamide, hydroxyethylacrylamide, phenylacrylamide, hydroxyphenylacrylamide, tolylacrylamide, naphthylacrylamide, dimethylacrylamide, diethylacrylamide, diisobutylacrylamide, N-(1,1-dimethyl-3-oxobutyl)-acrylamide, benzyloxyethylacrylamide, β-cyanoethylacrylamide, acryloylmorpholine, N-methyl-N-acryloylpiperazine, N-acryloylpiperidine, N-(1,1-dimethyl-3-hydroxybutyl)-acrylamide, N-β-morpholinoethylacrylamide, N-acryloylhexamethyleneimine, N-hydroxyethyl-N-methylacrylamide, N-2-acetamidoethyl-N-acetylacrylamide, acrylhydrazide, methacrylamide, methylmethacrylamide, t-butylmethylacrylamide, t-octylmethacrylamide, benzylmethacrylamide, cyclohexylmethacrylamide, phenylmethacrylamide, diethylmethacylamide, N-hydroxyethyl-N-methylmethacrylamide, N-methyl-N-phenylmethacrylamide, methacrylhydrazide, crotonamide, butyl crotonate, hexyl crotonate, glycerol monocrotonate, dihydroxyethylamide of crotonic acid, methyl vinyl ketone, methoxyethyl vinyl ketone, dimethyl itaconate, diethyl itaconate, diethyl maleate, dibutyl maleate, etc. If desired or necessary, one or more of the α,β-unsaturated carboxylic acid derivatives and/or of the α,β-unsaturated ketones can be used. The addition reaction of amines with α,β-unsaturated carboxylic acid derivatives or α,β-unsaturated ketones is well known as the Michael Reaction. However, of the above α,β-unsaturated carboxylic derivatives and α,β-unsaturated ketones, acrylic esters, methacrylic esters, acrylamides and the like which are represented by the aforesaid general formulae (a), (b), (e) and (i) are preferred and particularly useful from the viewpoint of reactivity with the amines and the desensitizing capability of the resulting product.

Typical example of the synthesis of the compounds of this invention by the addition reaction of an amine and an acrylic acid derivative and specific examples of such compounds are shown below, which are not intended to limit this invention. It should be understood, in this regard, that the addition reaction products are not 1:1:1 molar products. The addition reaction occurs at the active hydrogen of an amine with an α,β-unsaturated carboxylic acid derivative or an α,β-unsaturated ketone. It is most preferrred to add the α,β-unsaturated carboxylic acid derivative or α,β-unsaturated ketone until all of the active hydrogens of the amine are reacted. However, this is not mandatory and with some amines or some α,β-unsaturated carboxylic acid derivatives or α,β-unsaturated ketones a portion of the active hydrogen can remain after the addition reaction proceeds.

SYNTHESIS EXAMPLE 43.0 g (0.50 mol) of methyl acrylate was added dropwise to a solution of 11.4 g (0.06 mol) of tetraethylenepentamine and 40 ml of methanol at room temperature, and, then, stirring was effected at room temperature for 18 hours. Thereafter, excess acrylic ester was firstly distilled off using an aspirator (20 mmHg) and then further distilled off using a vacuum pump (0.5 mmHg) to obtain a compound A shown below. Compounds B to P were obtained by reacting the corresponding amine with the corresponding acrylic acid derivative in the same manner at 25° to 80° C. Unless otherwise indicated, reaction was at atmospheric pressure.

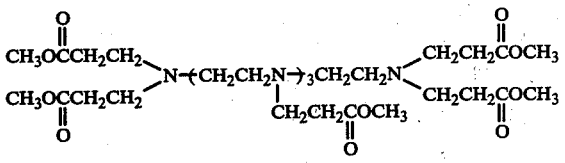
(Compound A)

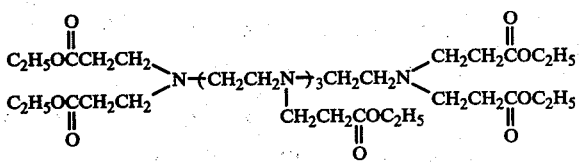
(Compound B)

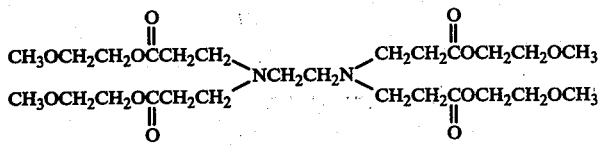
(Compound C)

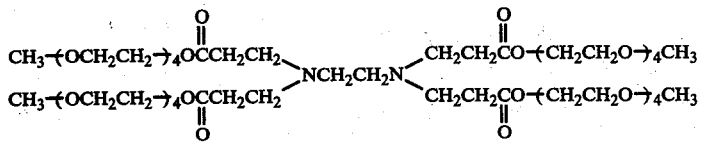
(Compound D)

-continued
(Compound E)
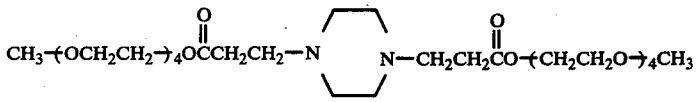
(Compound F)
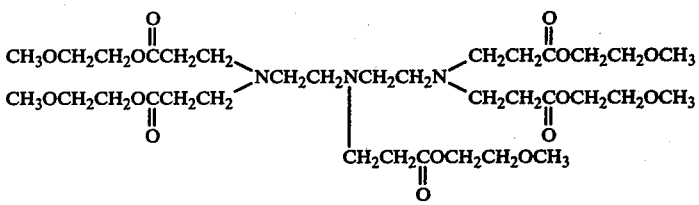
(Compound G)
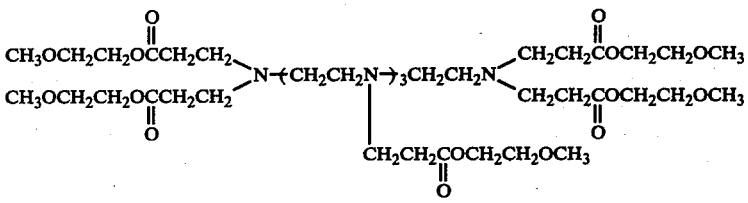
(Compound H)
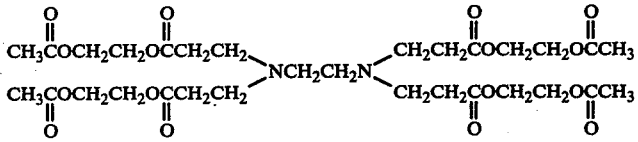
(Compound I)
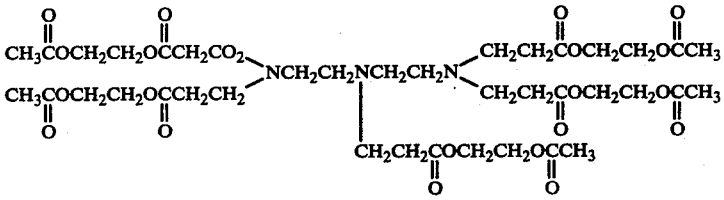
(Compound J)
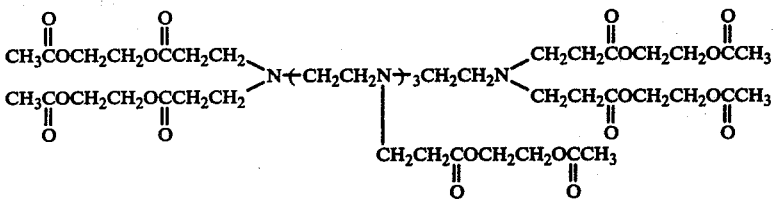
(Compound K)
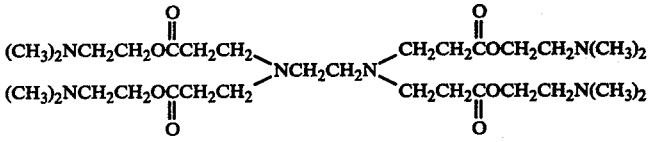
(Compound L)
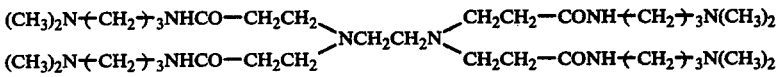
(Compound M)
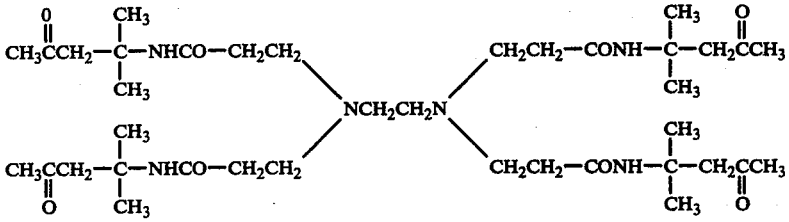
(Compound N)
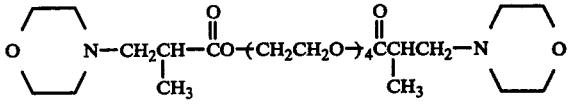

-continued

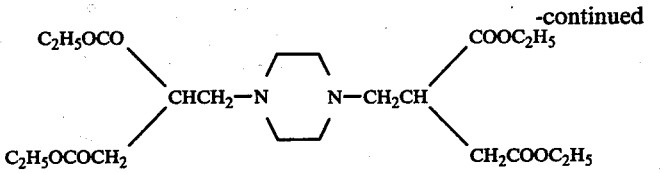

(Compound O)

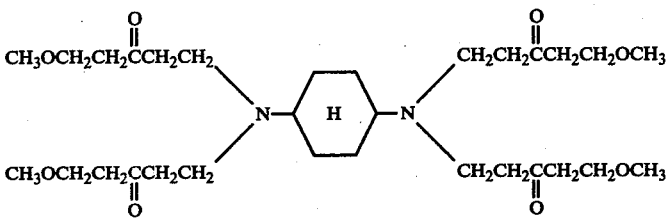

(Compound P)

The desensitizing composition of this invention must contain at least one compound obtained by the addition reaction of $\alpha,\beta$-unsaturated carboxylic acid derivatives or $\alpha,\beta$-unsaturated ketones with amines, but other various components can also be present. The term "other components" as used herein includes those described in detail in E.A. Apps, *Printing Ink Technology,* Chapter 2 to 9, Leonard Hill (London) (1961), for example, materials for conventional printing inks other than colorless formers and adsorbents. Examples are natural or synthetic high molecular weight compounds (used as a binder in most cases, but use is not necessarily limited thereto) such as ketone resins, polyamide resins, maleic acid resins, fumaric acid resins, phenol resins, epoxy resins, alkyd resins, melamine resins, urea resins, acrylic resins, nitrocellulose, methyl cellulose, cellulose acetate butyrate, butyral resins, casein, gelatin and polyvinyl alcohol; pigments (to improve printability, brightness and covering power) such as titanium oxide, zinc oxide, barium sulfate, magnesium carbonate, calcium carbonate, barium carbonate, magnesium hydroxide and talc; solvents such as glycols (for example, ethylene glycol, diethylene glycol, glycerol, polyethylene glycol, polypropylene glycol, etc.) and alcohols such as ethanol, butanol and amyl alcohol; fats and oils (to improve wear resistance) such as paraffin and Japan wax, drying oils such as linseed oil, tung oil and soybeen oil, semi-drying oils such as cotton seed oil, rapeseed oil and rice bran oil. If desired or necessary, other known additives, for example, anti-offset agents such as starch, other desensitizers, etc., can also be present.

The composition of this invention may be in various forms such as an aqueous solution, a solution of an organic solvent, an aqueous dispersion, a paste or a solid. Preferred of such organic solvents are alcohols (e.g., ethanol), esters (e.g., ethyl acetate) and hydrocarbon solvents (e.g., benzene). When the composition of this invention is used in the form of an aqueous solution, a solution of an organic solvent, an aqueous dispersion, paste or a solid, the proportion of the active ingredient (desensitizer compound(s)) is generally about 10 to about 90 weight % of the total composition, more preferably 30 to 90 weight %, same basis. It should be noted that the effect of the aforesaid composition is not adversely influenced by the types and amounts of other components incorporated in the composition, or the form of the composition.

The desensitizing composition in accordance with the present invention contains at least one compound obtained by the addition reaction of one or more $\alpha,\beta$-unsaturated carboxylic acid derivatives and/or one or more $\alpha,\beta$-unsaturated ketones with one or more amines and, generally, but not mandatorily, a natural or synthetic high molecular weight compound as above exemplified as a binder. Typically, the weight ratio of the binder to the desensitizing compound(s) of the present invention is from about 5 to about 30 weight %. In many instances it is preferred to utilize one or more pigments with the desensitizing compound(s) of the present invention, whether a binder is present or not, and in such a case the pigment(s) is/are typically used in an amount of from about 1 to about 60 weight %, more preferably 5 to 40 weight %, of the total desensitizer composition. Solvents are also often used, typically in an amount of 0 to 20 weight %, more preferably 0 to 5 weight %, based on the desensitizer composition.

The desensitizing composition of this invention can be applied to various recording materials. Such recording materials are those which take advantage of the color reaction caused by contacting a color former with an adsorbent. They include, for example, recording materials as described in U.S. Pat. No. 2,505,470, 2,505,489, 2,548,366 and 2,550,471; recording materials as described in U.S. Pat. Nos. 2,712,507, 2,730,456, 2,730,457 and 3,293,060; recording materials as described in U.S. patent application Ser. No. 40,732 and British Pat. No. 825,354; and other recording materials used for spirit printing, stencil printing, automatic winding and selling system, fingerprinting systems, letter writing systems, and the like.

Typical examples of the recording materials are pressure-sensitive copying papers. Pressure-sensitive copying papers usually comprise an upper paper having a surface coated with microcapsules containing an electron-donating, colorless organic compound (hereinafter referred to as a color former) dissolved in an oil and a lower paper having a surface on which an electron-accepting substance, i.e., an adsorbent, is coated using a suitable binder such as gelatin, starch or styrene-butadiene latex. When both papers are one upon another so that the coated surfaces are facing each other and pressure is applied by writing by hand or typewriting, or by other means, capsules in the pressurized portions are destroyed, and the colorless color former thus comes into contact with and is adsorbed by the adsorbent to cause color formation.

Moreover, those pressure-sensitive copying papers in which an interlayer paper having the back surface coated with a color former and the front surface coated with an adsorbent is put between an upper paper and a lower paper can also be used.

In these recording materials, there are usually present areas in which the formation of a color image is not required or is not permitted. In such cases, it is advantageous to prevent the color reaction by using the desensitizing composition of this invention in such portions.

The adsorbent-containing portions in the recording material can be coated or impregnated with the desensitizing composition of this invention in various manners. For example, there can be used a method of making the composition into inks for letterpress printing or gravure printing and then printing the same, a method of charging the composition with Freon gas or the like and then spraying the same, a method of spraying the composition dissolved in an organic solvent such as an alcohol (for example, methanol or ethanol) or as an aqueous solution through a pattern using a spray, a method of placing the composition in solution form such as in toluene in a container and then coating the same on the portions to be treated, a method of kneading the composition with a cream such as vanishing cream or cold cream and then coating the same by means of fingers and a method of compounding the desensitizer with solid polyethylene glycol, paraffin, Japan wax, titanium dioxide or the like and then using the same in a crayon or eraser-like form.

The adsorbents used in this invention are electron-accepting substances and are well known in the art. Specific examples of them are clay minerals such as acid clay and attapulgite; organic acids such as tannic acid, gallic acid and propyl gallate; acid polymers such as phenol-formaldehyde resins and phenol-acetylene condensation resins; metal salts of aromatic carboxylic acids such as zinc salicylate, tin salicylate, zinc 2-hydroxynaphthoate and zinc 3,5-di-t-butylsalicylate; and mixtures thereof. The adsorbent is coated together with a binder such as styrene-butadiene latex on a paper, plastic film-laminated paper or other supports. Such adsorbents are well known and many examples thereof are disclosed in U.S. Pat. Nos. 3,934,070, 3,516,845, 3,427,180, 3,455,721, 2,712,507, 2,730,456 and 2,730,457. Generally, the adsorbent/binder weight ratio is from about 0.05 to about 2, more preferably 0.1 to 1.

On the other hand, the color formers which cause a color reaction with the adsorbent are electron-donating, substantial colorless organic compounds and include triarylmethane compounds, diphenylmethane compounds, xanthene compounds, thiazine compounds, spiropyran compounds, and the like. Examples of the triarylmethane compounds are 3,3-bis-(p-dimethylaminophenyl)-6-dimethylaminophthalide, i.e., Crystal Violet Lactone, 3,3-bis-(p-dimethylaminophenyl)-phthalide, 3-(p-dimethylaminophenyl)-3-(1,2-dimethylindol-3-yl)-phthalide, 3-(p-dimethylaminophenyl)-3-(2-methylindol-3-yl)-phthalide, 3-(p-dimethylaminophenyl)-3-(2-phenylindol-3-yl)-phthalide, 3,3-bis-(1,2-dimethylindol-3-yl)-5-dimethylaminophthalide, 3,3-bis(1,2-dimethylindol-3-yl)-6-dimethylaminophthalide, 3,3-bis-(9-ethylcarbazol-3-yl)-5-dimethylaminophthalide, 3,3-bis-(2-phenylindol-3-yl)-5-dimethylaminophthalide and 3-p-dimethylaminophenyl-3-(1-methylpyrrol-2-yl)-6-dimethylaminophthalide. Examples of the diphenylmethane compounds are 4,4'-bis-dimethylaminobenzhydrin benzyl ether, N-halophenylleucoauramine and N-2,4,5-trichlorophenyl-leucoauramine. Examples of the xanthene compounds are rhodamine B-anilinolactam, rhodamine(p-nitroanilino)-lactam, rhodamine B-(p-chloroanilino)lactam, 3-dimethylamino-7-methoxyfluoran, 3-diethylamino-7-methoxyfluoran, 3-diethylamino-6-methoxyfluoran, 3-diethylamino-7-chlorofluoran, 3-diethylamino-7-chloro-6-methylfluoran, 3-diethylamino-6,8-dimethylfluoran, 3-diethylamino-(7-acetylmethylamino)-fluoran, 3-diethylamino-(7-methylamino)-fluoran, 3,7-diethylaminofluoran, 3-diethylamino-7-(dibenzylamino)-fluoran, 3-diethylamino-7-(methylbenzylamino)-fluoran, 3-diethylamino-7-(chloroethylmethylamino)-fluoran and 3-diethylamino-7-(diethylamino)-fluoran. Examples of the thiazine compounds are Benzoyl Leucomethylene Blue and p-nitrobenzylleucomethylene blue. Examples of the spiro compounds are 3-methyl-spirodinaphthopyran, 3-ethyl-spiro-dinaphthopyran, 3,3'-dichloro-spiro-dinaphthopyran, 3-benzylspirodinaphthopyran, 3-methyl-naphtho(3-methoxy-benzo)-spiropyran and 3-propyl-spiro-dibenzopyran.

The color former can be dissolved in a synthetic or natural oil such as chlorinated diphenyl, chlorinated terphenyl, alkylated terphenyl, chlorinated paraffin, chlorinated naphthalene, alkylated naphthalene, kerosene, paraffin or naphthene oil and then coated together with a binder on a support. Alternatively, it can encapsulated by any conventional method, e.g., by the method described in U.S. Pat. No. 2,800,457, and then coated on a support, if desired or necessary, together with additives, for example, an anti-smudge agent such as starch particles. In another embodiment, a solution of the color former can be coated only on the portions where the color former is required. The color former and the adsorbent may be used in a form suitable for pressure sensitive recording papers or heat sensitive copying papers or for any other purpose, as described above.

The use of the desensitizing composition of this invention provides the following effects: a satisfactory desensitizing effect is obtained, discoloring, fading or bleeding of a coloring ink does not occur, no yellowing occurs, the desensitizing effect does not extend to other portions, fog due to desensitization is not produced, etc.

The above disclosure will enable one to practice the present invention with ease. However, as with most inventions, for commercial products certainly highly preferred conditions of use exist, which are discussed below. These are not, however, unduly limitative on the present invention.

Firstly, the densitizing composition in accordance with the present is preferably coated in an amount, to achieve optimum effects, of from about 0.5 to about 10 $g/m^2$, even more preferably 1.0 to 8.0 $g/m^2$. Such is utilized in combination with a coated amount of adsorbent of from about 0.5 to 10 $g/m^2$, more preferably 1.0 to 6.0 $g/m^2$. Such will typically be utilized in combination with a color former in a coated amount of about 0.005 to about 5 $g/m^2$, even more preferably 0.01 to 5.0 $g/m^2$.

This invention will be illustrated in detail by the following examples, by which the excellent effects of this invention will be easily understood.

Adsorbent sheets, color former sheets and desensitizing inks which were used in the examples to confirm the effects of the desensitizers were prepared in the following manner. In the examples, all parts are by weight.

PREPARATION OF ADSORBENT SHEET A 100 parts of acid clay which had been treated with sulfuric acid by immersion therein at room temperature (about 25° C.) was dispersed in 280 parts of water containing 10 parts of 20% sodium hydroxide using a homogenizer, and, then, 10 parts of a 10% aqueous solution of the sodium salt of methyl vinyl ether — maleic anhydride copolymer (trade name: GANTREZ-AN-119, made by General Aniline & Film Corporation; intrinsic viscosity: 0.1 to 0.5) and 37 aprts of styrene-butadiene latex (trade name: Dow Latex, made by Dow Chemical Company; molar ratio of styrene/butadiene = 6/4; 50 weight % solution) were added thereto. The coating composition thus obtained was coated on a base paper of 50 g/m$^2$ by air knife coating so as to provide a solids content of 10 g/m$^2$ and then dried, thus preparing an adsorbent sheet.

PREPARATION OF ADSORBENT SHEET B 170 parts of p-phenylphenol, 70 parts of a 37% aqueous solution of formaldehyde and 50 parts of water were subjected to condensation in the presence of 36% hydrochloric acid (as a catalyst) at 160° C. and then cooled to give a phenol resin powder.

50 parts of the phenol resin, 10 parts of polyvinyl alcohol (trade name: PVA-205, made by Kuraray Co., Ltd.; degree of polymerization: 500; degree of saponification: 200) and 500 parts of water were blended in a ball mill for 10 hours to obtain a coating composition (coating composition B).

The coating composition was coated on base paper of 50 g/m$^2$ so as to provide a solids content of 2 g/m$^2$ and then dried, thus preparing an adsorbent sheet B.

PREPARATION OF ADSORBENT SHEET C 4 parts of sodium hydroxide was dissolved in 200 parts of water, and then, 25 parts of 3,5-di-t-butylsalicylic acid was dissolved therein with stirring.

Moreover, a solution of 7 parts of zinc chloride dissolved in 100 parts of water was slowly added while stirring. Then, 50 parts of a 10% aqueous solution of polyvinyl alcohol (trade name: PVA 205, made by Kuraray Co., Ltd.) was added, and blending was effected by means of a ball mill for 10 hours to make a coating composition C.

The coating composition was coated on a base paper of 50 g/m$^2$ so as to provide a solids content of 2 g/m$^2$ and then dried, thus preparing an adsorbent sheet C.

PREPARATION OF ADSORBENT SHEET D

A coating composition obtained by blending 35 parts of the aforesaid coating composition B, 50 parts of the aforesaid coating composition C and 15 parts of agalmatolite in a ball mill for 10 hours was coated on a base paper of 50 g/m$^2$ so as to provide a solids content of 2 g/m$^2$ and then dried to obtain an adsorbent sheet D.

PREPARATION OF COLOR FORMER SHEET A 10 parts of acid treated gelatin having an isoelectric point of 3.0 and 10 parts of gum arabic were dissolved in 60 parts of water at 40° C., and 0.2 part of sodium alkylbenzenesulfonate was added as an emulsifier thereto. Then, 50 parts of a color former-containing oil was emulsified therein.

The color former-containing oil had been prepared by dissolving 2.5% by weight of Crystal Violet Lactone and 2.0% by weight of Benzoyl Leucomethylene Blue in an oil consisting of 4 parts of diisopropylbiphenyl and 1 part of kerosene.

When the size of emulsion droplets reached 8 $\mu$ on the average, 100 parts of water at 40° C. was added to inhibit further emulsification.

While stirring, 210 parts of water at 30° C. was further added, and, then, 20% hydrochloric acid was added to adjust the pH of the system to 4.4. While further stirring, the system was cooled to 8° C., and, then, 1.5 parts of 20% glutaraldehyde was added thereto.

Subsequently, 30 parts of a 10% carboxymethylstarch solution was poured therein, and 25% sodium hydroxide was dropwise added to adjust the pH to 8.5. Thereafter, the temperature of the system was raised to 30° C. to form microcapsules having a hardened wall.

10 parts of cellulose flock was dispersed in the composition thus obtained, which was then coated on a paper of 40 g/m$^2$ so as to provide a solids content of 6 g/m$^2$, thus preparing a color former sheet A.

PREPARATION OF COLOR FORMER SHEET B

A color former-containing oil was prepared by dissolving 1% by weight of Crystal Violet Lactone, 4% by weight of 3-diethylamino-7-diethylaminofluoran, 4% by weight of 3-diethylamino-7-phenylaminofluoran, 3% by weight of 3-diethylamino-7,8-benzofluoran, 0.5% by weight of 3,6-bismethoxy-fluoran and 2% by weight of Benzoyl Leucomethylene Blue in an oil consisting of 1 part of diisopropylnaphthalene, 1 part of diisopropylbiphenyl and 2 parts of 1-(dimethylphenyl)-1-phenylethane. A color former sheet B was prepared using 50 parts of the above color former-containing oil in the same manner as in the preparation of the color former sheet A.

PREPARATION OF DESENSITIZING INKS

A varnish in which 60 parts of a desensitizer shown in the following table and 30 parts of rosin-modified maleic acid resin (trade name: Malckeed 33, made by Arakawa Rinsan Kagaku Kogyo K.K., degree of oxidation: 220 to 320; softening point: 140° C.) as a binder were dissolved by heating was kneaded with 10 parts of titanium dioxide by means of a threeroll mill, and, then, 2 parts of polyethylene glycol (average molecular weight of 400) was added to obtain an ink. The ink was applied by printing to each of the adsorbent sheets in a coating amount of 5 g/m$^2$.

TEST METHOD

Each of the desensitizing compositions prepared as above was applied by printing to each of the adsorbent sheets. The desensitized areas of the adsorbent sheet and the color former sheet were placed facing each other, and a load of 600 kg/cm$^2$ was applied to cause color formation. After the sheets were left to stand for a whole day and night, the density was measured by means of a microdensitometer, and the desensitizing effect was evaluated from the obtained reflection visual density (Vis. D.).

| Example and Comparative Example | Desensitizer | Desensitizing Effect (Vis. D.) | | | | | Bleeding, Discoloring and Fading of Coloring Inks |
|---|---|---|---|---|---|---|---|
| | | Color Former Sheet A | | | | Color Former Sheet B | |
| | | Adsorbent Sheet A | Adsorbent Sheet B | Adsorbent Sheet C | Adsorbent Sheet D | Adsorbent Sheet A | |
| Example | | | | | | | |

-continued

| Example and Comparative Example | Desensitizer | Desensitizing Effect (Vis. D.) Color Former Sheet A Adsorbent Sheet A | Adsorbent Sheet B | Adsorbent Sheet C | Adsorbent Sheet D | Color Former Sheet B Adsorbent Sheet A | Bleeding, Discoloring and Fading of Coloring Inks |
|---|---|---|---|---|---|---|---|
| 1 | Compound A | 0.06 | 0.06 | 0.07 | 0.07 | 0.06 | satisfactory |
| 2 | Compound B | 0.06 | 0.06 | 0.07 | 0.07 | 0.06 | " |
| 3 | Compound C | 0.05 | 0.05 | 0.06 | 0.07 | 0.05 | " |
| 4 | Compound D | 0.05 | 0.06 | 0.06 | 0.06 | 0.06 | " |
| 5 | Compound E | 0.06 | 0.06 | 0.07 | 0.07 | 0.06 | " |
| 6 | Compound F | 0.05 | 0.05 | 0.05 | 0.06 | 0.05 | " |
| 7 | Compound G | 0.06 | 0.06 | 0.06 | 0.06 | 0.06 | " |
| 8 | Compound H | 0.05 | 0.05 | 0.05 | 0.06 | 0.05 | " |
| 9 | Compound I | 0.05 | 0.05 | 0.05 | 0.05 | 0.05 | " |
| 10 | Compound J | 0.06 | 0.06 | 0.06 | 0.06 | 0.06 | " |
| 11 | Compound K | 0.06 | 0.06 | 0.07 | 0.07 | 0.06 | " |
| 12 | Compound L | 0.06 | 0.06 | 0.07 | 0.07 | 0.06 | " |
| 13 | Compound M | 0.06 | 0.06 | 0.07 | 0.07 | 0.06 | " |
| 14 | Compound N | 0.06 | 0.07 | 0.07 | 0.07 | 0.06 | " |
| Comparative Example | | | | | | | |
| 1 | without desensitizing | 1.08 | 1.05 | 0.94 | 1.04 | 1.05 | — |
| 2 | $C_{12}H_{25}NH_2$ | 0.35 | 0.40 | 0.45 | 0.35 | 0.40 | unsatisfactory |
| 3 | $C_{18}H_{37}N(CH_2CH_2O)_xH)(CH_2CH_2O)_yH$ (x + y = 10) | 0.06 | 0.11 | 0.15 | 0.12 | 0.11 | " |
| 4 | $HO(CH_2CH_2O)_{10}H$ | 0.28 | 0.35 | 0.37 | 0.36 | 0.34 | " |

The values in the above table indicate the desensitizing effect, and the smaller the value, the higher the effect. A value of 0.05 to 0.07 shows a nearly complete desensitizing effect. Moreover, a difference of 0.05 or more means a remarkable difference in the desensitizing effect. Therefore, the utility of the desensitizing composition in which the compound of this invention is used can be seen from the above table. Among the conventional desensitizers, the desensitizing composition containing the compound of Comparative Example 3 is more satisfactory than the other ones, but when compared with the desensitizing compositions containing the compounds of this invention, there are remarkable differences in desensitizing effect, and, thus, it is obviously inferior to the desensitizing compositions of this invention. In addition, when the desensitizing composition containing the compound of Comparative Example 3 is used, bleeding, discoloring and fading of printing inks, ball point inks, inks for fountain pens, cinnabar seal inks and other inks are caused, while the desensitizers of this invention have no adverse effects on the inks. Also in this point, the desensitizers of this invention are highly advantageous.

While the invention has been described in detail and with reference to specific embodiments thereof, it will be apparent to one skilled in the art that various changes and modifications can be made therein without departing from the spirit and scope thereof.

What is claimed is:

1. A method of desensitizing an adsorbant contained in a pressure-sensitive recording material, said absorbant being an electron-acceptor and forming color upon reaction with a colorless color former which is an electron-donater, which comprises applying a desensitizing composition containing at least one compound obtained by the addition reaction of one or more $\alpha,\beta$-unsaturated acid derivatives or one or more $\alpha,\beta$-unsaturated ketones with one or more amines, in said addition reaction, a nitrogen atom(s) of said one or more amines being bonded to a $\alpha,\beta$-unsaturated carbon atom of said one or more $\alpha,\beta$-unsaturated acid derivatives or said one or more $\alpha,\beta$-unsaturated ketones to portions of the absorbent where color formation is not required.

2. The method of claim 1, wherein said $\alpha,\beta$-unsaturated carboxylic acid derivative is an ester or amide derivative of acrylic acid, methacrylic acid, crotonic acid, isocrotonic acid, maleic acid, fumaric acid or itaconic acid.

3. The method of claim 1, wherein said $\alpha,\beta$-unsaturated ketone is methylvinyl ketone or methoxymethylvinyl ketone.

4. The method according to claim 1, wherein said amine is ammonia, a primary or secondary aliphatic amine, an alicylic amine, a cyclic amine or an aromatic amine, which amine has at least one active hydrogen.

5. The method of claim 1, wherein said desensitizing composition further comprises a binder.

6. The method of claim 1, wherein said desensitizing composition further comprises a pigment.

7. The method of claim 1, wherein said desensitizing composition further comprises a solvent.

8. The method of claim 1, wherein said amines are represented by the general formulae:

$R_1NH_2$
$R_1NHR_2$
$H_2NR_3NH_2$

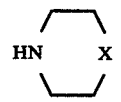

wherein $R_1$ and $R_2$ each represent an alkyl group having 1 to 20 carbon atoms; an alkenyl group; an alkyl group substituted with a hydroxyl group, a phenyl group, or a methoxy substituted phenyl group, a morpholino group or a piperazinyl group, where the alkyl moiety has 1 to 20 carbon atoms; a substituted alkenyl group; an alicyclic hydrocarbon group; a phenyl group; a methyl substituted phenyl group; a methoxy substituted phenyl group; or a pyridinyl group, and wherein $R_1$ and $R_2$ may be identical or different; $R_3$ represents an alkylene group having 1 to 8 carbon atoms; a cyclohexylene group; a polyazaalkylene group; a pentaiminohexa(methylene)group; a phenylene group; or a pyridylene group; and X represents an imino group, oxy or methylene.

9. The method of claim 8, wherein said $\alpha,\beta$-unsaturated carboxylic acid derivatives and said $\alpha,\beta$-unsaturated ketones are represented by the general formulae:

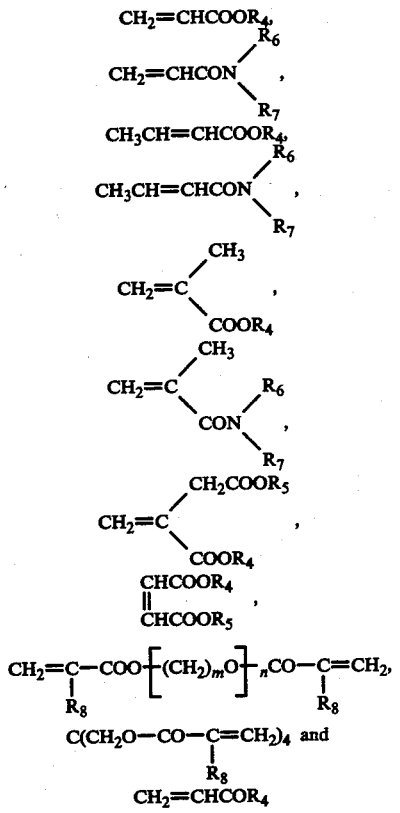

wherein $R_4$ and $R_5$ each represents an alkyl group having 1 to 12 carbon atoms; a substituted alkyl group substituted with a phenoxy group, a hydroxy group, a cyano group, an amino group, a hexyloxy group, a sulfo group, or an alkoxy group having 1 to 10 carbon atoms, wherein the alkyl moiety of the substituted alkyl group has 1 to 20 carbon atoms; a benzyl group; a cyclohexyl group; a saturated or unsaturated 6-membered heterocyclic group having 1 nitrogen atom or 1 oxygen atom; a phenyl group; a naphthyl group; or a polyoxyalkylene group of the formula — $[(CH_2]-_{m_1}O]_{n_1}$, wherein $m_1$ is an integer of 2 to 4 and $n_1$ is an integer of 1 to 14; wherein $R_4$ and $R_5$ may be identical or different; $R_6$ and $R_7$ each represents a hydrogen atom; an alkyl group having 1 to 12 carbon atoms; a cyclohexyl group; a substituted alkyl group wherein the substituent is a hydroxyl group, an alkoxy group having 1 to 6 carbon atoms, a dimethylamino group, a diethylamino group, an acyl group having 1 to 6 carbon atoms, a cyano group, a piperazinyl group, or a morpholinyl group, where the alkyl moiety of the substituted alkyl group has 1 to 10 carbon atoms; a phenyl group; a naphthyl group; an acetyl group; or a saturated or unsaturated 6-membered heterocyclic group having 1 nitrogen atom or 1 oxygen atom; and wherein $R_6$ and $R_7$ may be the same or different or may form a ring having 4 or 5 carbon atoms; $R_8$ is a hydrogen atom or a methyl group; and wherein $m$ is an integer of 2 to 4 and $n$ is integer of 1 to 14.

10. The method of claim 1, wherein said adsorbent is selected from the group consisting of clay minerals, organic acids, acid polymers, metal salts of aromatic carboxylic acids and mixtures thereof.

11. The method of claim 1, wherein said at least one compound is obtained by the addition reaction of one or more $\alpha,\beta$-unsaturated acid derivatives with one or more amines.

12. The method of claim 1, wherein said at least one compound is obtained by the addition reaction of one or more $\alpha,\beta$-unsaturated ketones with one or more amines.

13. The method of claim 1, wherein said one or more $\alpha,\beta$-unsaturated acid derivatives is an ester derivative.

14. The method of claim 1, wherein said one or more $\alpha,\beta$-unsaturated acid derivatives is an amide derivative.

15. The method of claim 1, wherein said color former is selected from the group consisting of a triarylmethane compound, a diphenylmethane compound, a xanthane compound, a thiazine compound or a spiropyran compound.

* * * * *